US008205586B2

(12) United States Patent
Strauss et al.

(10) Patent No.: US 8,205,586 B2
(45) Date of Patent: Jun. 26, 2012

(54) APPARATUS FOR THE VARIABLE SETTING OF THE CONTROL TIMES OF GAS EXCHANGE VALVES OF AN INTERNAL COMBUSTION ENGINE

(75) Inventors: Andreas Strauss, Forchheim (DE); Michael Busse, Herzogenaurach (DE); Joachim Dietz, Frensdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 373 days.

(21) Appl. No.: 12/526,832

(22) PCT Filed: Feb. 8, 2008

(86) PCT No.: PCT/EP2008/051533

§ 371 (c)(1),
(2), (4) Date: Aug. 12, 2009

(87) PCT Pub. No.: WO2008/098874

PCT Pub. Date: Aug. 21, 2008

(65) Prior Publication Data

US 2010/0037841 A1 Feb. 18, 2010

(30) Foreign Application Priority Data

Feb. 13, 2007 (DE) ..... 10 2007 007 072

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,439,181 B1 8/2002 Fujiwaki et al.
2003/0121486 A1 7/2003 Komazawa

FOREIGN PATENT DOCUMENTS

DE 101 28 694 A 12/2001
EP 1 452 700 A 9/2004

*Primary Examiner* — Zelalem Eshete
(74) *Attorney, Agent, or Firm* — Lucas & Mercanti, LLP; Klaus P. Stoffel

(57) ABSTRACT

An apparatus for variable setting of control times of gas exchange valves of an internal combustion engine which has an outer and inner rotor rotatable relative to the former, with one component drive-connected to a crankshaft and the other drive-connected to a camshaft. The apparatus has at least one pressure space, which are each divided into two pressure chambers acting counter to one another. The apparatus has a plurality of pressure medium channels, via which pressure medium is fed to or led away from the pressure chambers. Additionally, the apparatus has a plurality of rotational-angle limitation devices assuming an unlocked and locked state. The locking states are set by the supply of pressure medium to or discharge of pressure medium from the respective rotational-angle limitation apparatus. Furthermore, a method for controlling an apparatus for variable setting of control times of gas exchange valves of an internal combustion engine is disclosed.

20 Claims, 6 Drawing Sheets

| | Situation | Chamber A | Chamber B + pin $B_2$ | Pin A + pin $B_1$ |
|---|---|---|---|---|
| 1 | Engine start + locking (MAGV not supplied with current) | T | P | T |
| 2 | Unlocking and adjustment in late direction | T | P | P |
| 3 | Hold angle position | - | - | P |
| 4 | Adjustment in early direction | P | T | P |

Fig. 3a
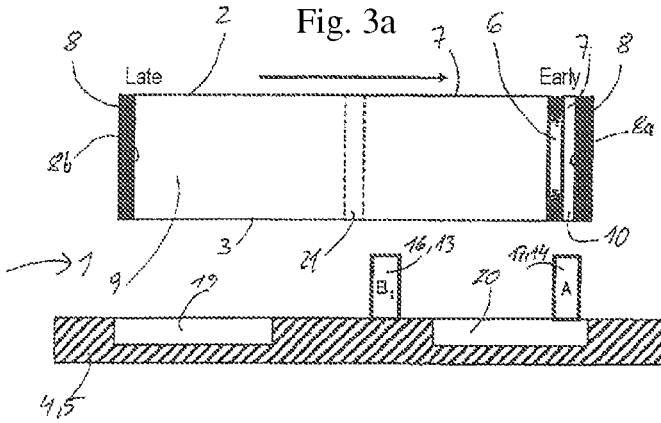
Fig. 3c
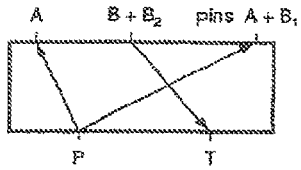
Fig. 3b
Fig. 4a
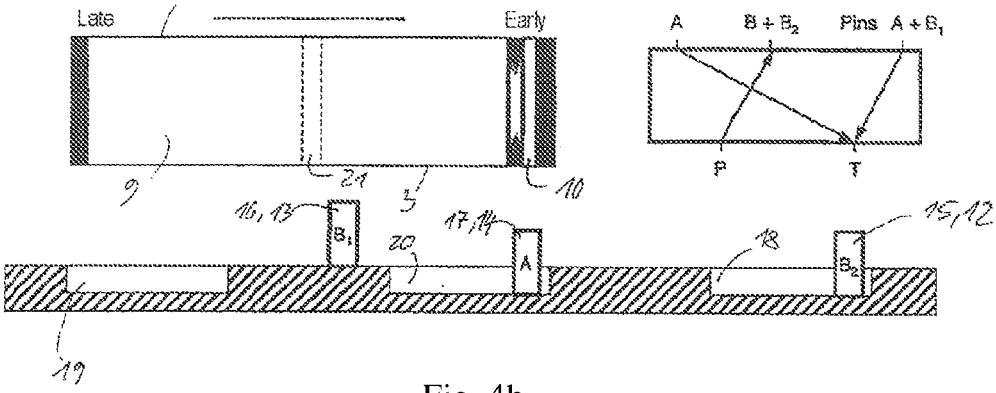
Fig. 4c
Fig. 4b

Fig. 5a
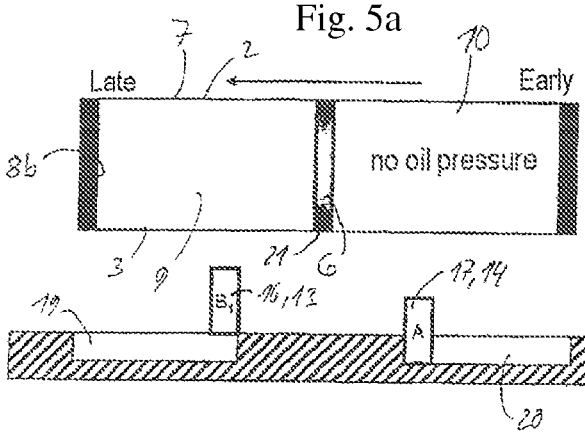
Fig. 5c
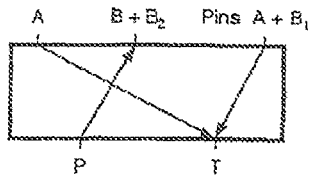
Fig. 5b
Fig. 6a
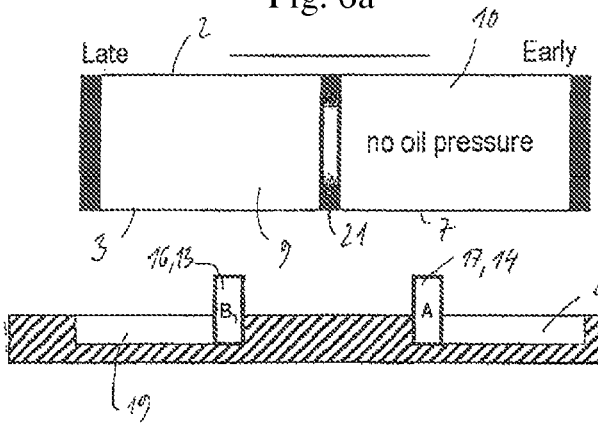
Fig. 6c
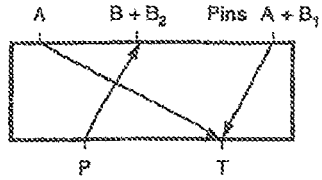
Fig. 6b Fig. 7a
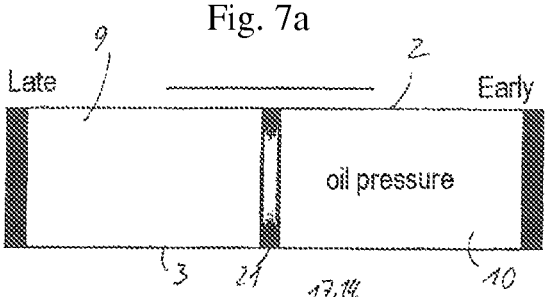
Fig. 7c
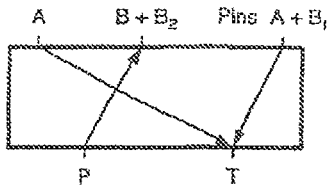
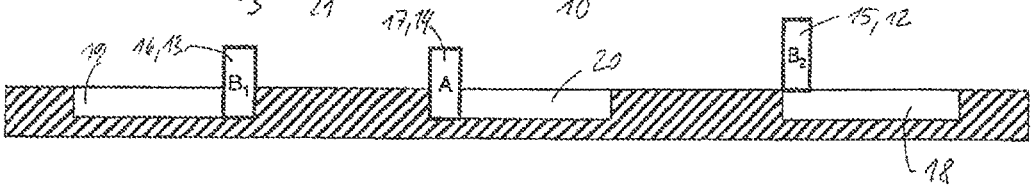
Fig. 7b
Fig. 8a
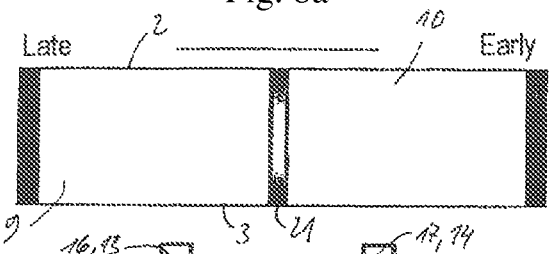
Fig. 8c
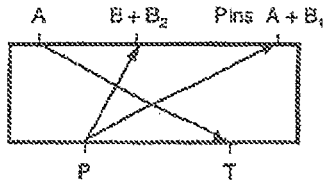
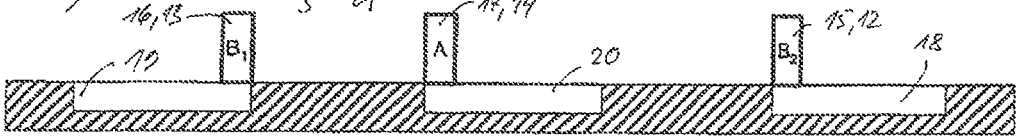
Fig. 8b Fig. 9a
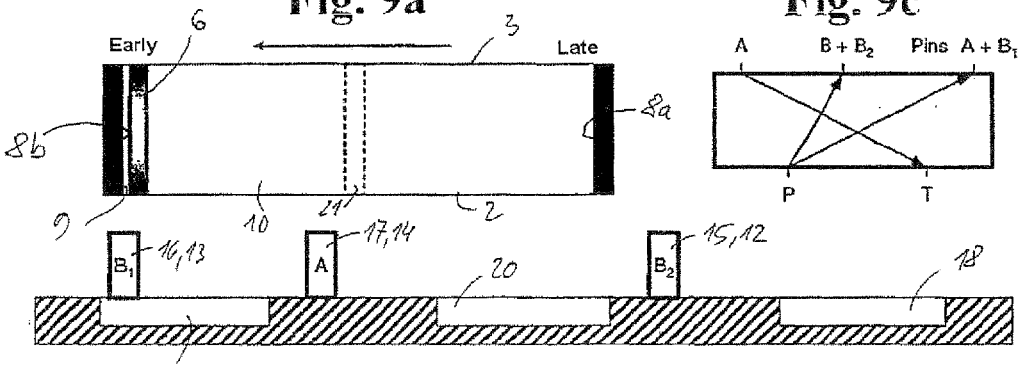
Fig. 9c
Fig. 9b
Fig. 10a
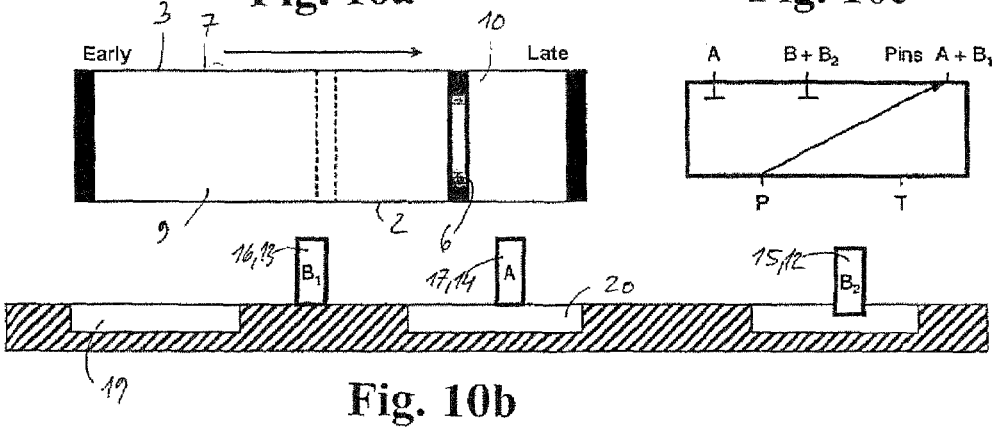
Fig. 10c
Fig. 10b Fig. 11a
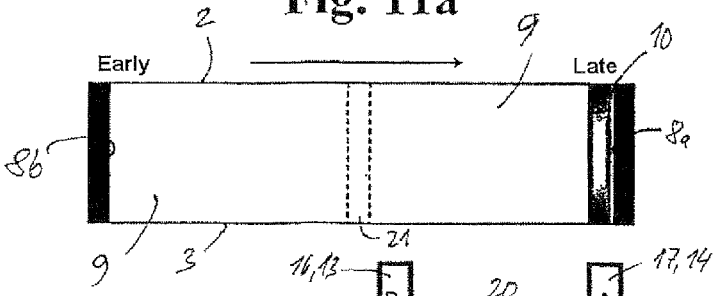
Fig. 11c
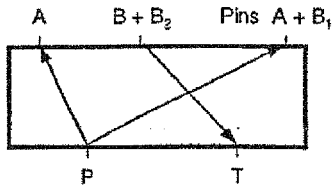
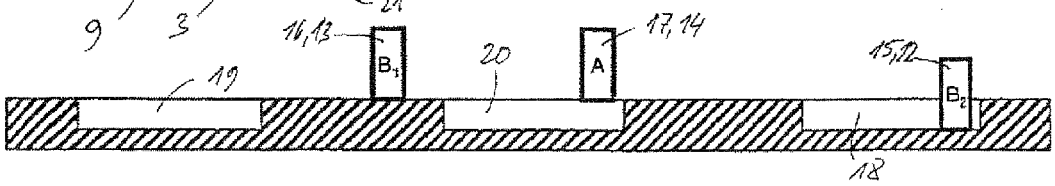
Fig. 11b

APPARATUS FOR THE VARIABLE SETTING OF THE CONTROL TIMES OF GAS EXCHANGE VALVES OF AN INTERNAL COMBUSTION ENGINE

This application is a 371 of PCT/EP2008/051533 filed Feb. 8, 2008, which in turn claims the priority of DE 10 2007 007 072.3 filed Feb. 13, 2007, the priority of both applications is hereby claimed and both applications are incorporated by reference herein.

FIELD OF THE INVENTION

The invention relates to a device for variably adjusting the control times of gas exchange valves of an internal combustion engine, having an outer rotor and an inner rotor which is arranged so as to be rotatable relative to said outer rotor, with one of the components being drive-connected to a crankshaft and with the other component being drive-connected to a camshaft. The device has at least one pressure space and each pressure space is divided into two pressure chambers which act counter to one another. Pressure medium can be supplied to or discharged from the pressure chambers via a plurality of pressure medium ducts. Also provided are a plurality of rotational angle limiting devices, with it being possible for each rotational angle limiting device to assume a locked state and an unlocked state, with it being possible for the locking states to be set by means of a supply of pressure medium to or a discharge of pressure medium from the respective rotational angle limiting devices. Each of the rotational angle limiting devices can assume two possible locking states, specifically a locked state, in which mechanical coupling is generated between the rotors by the respective rotational angle limiting device, and an unlocked state, in which the mechanical coupling between the rotors by the respective rotational angle limiting device is eliminated.

BACKGROUND OF THE INVENTION

In modern internal combustion engines, devices for variably adjusting the control times of gas exchange valves are used in order to be able to variably configure the phase relationship between the crankshaft and camshaft in a defined angle range between a maximum early position and a maximum late position. For this purpose, the device is integrated into a drivetrain via which a torque is transmitted from the crankshaft to the camshaft. Said drivetrain may, for example, be realized as a belt drive, chain drive or gearwheel drive.

The device comprises at least two rotors which are rotatable relative to one another, with one rotor being drive-connected to the crankshaft and with the other rotor being rotationally fixedly connected to the camshaft. The device comprises at least one pressure space which is divided by means of a movable element into two pressure chambers which act counter to one another. The movable element is operatively connected to at least one of the rotors. By means of a supply of pressure medium to or a discharge of pressure medium from the pressure chambers, the movable element is displaced within the pressure chamber, thereby effecting a targeted rotation of the rotors relative to one another and therefore of the camshaft relative to the crankshaft.

Here, one of the pressure chambers of each pressure space acts as a lead chamber and the other acts as a lag chamber. By means of a supply of pressure medium to the lead chambers with a simultaneous discharge of pressure medium from the lag chambers, the rotor which interacts with the camshaft is rotated relative to the rotor which interacts with the crankshaft in the direction of a maximum early position. By means of a supply of pressure medium to the lag chambers with a simultaneous discharge of pressure medium from the lead chambers, the rotor which interacts with the camshaft is rotated relative to the rotor which interacts with the crankshaft in the direction of a maximum late position.

The supply of pressure medium to and the discharge of pressure medium from the pressure chambers are controlled by means of a control unit, generally a hydraulic directional control valve (control valve). The control unit is in turn controlled by means of a regulator, which, by means of sensors, determines the actual position of the camshaft in the internal combustion engine and compares said actual position with a nominal position, which is dependent, in particular on the engine speed and the load state of the internal combustion engine. If a difference is detected between the two positions, a signal is transmitted to the control unit which adapts the pressure medium flows to the pressure chambers to said signal.

To ensure the functioning of the device, the pressure in the pressure medium circuit of the internal combustion engine must exceed a certain value. Since the pressure medium is generally provided by the oil pump of the internal combustion engine and the provided pressure therefore rises synchronously with the rotational speed of the internal combustion engine, below a certain rotational speed, the oil pressure is still too low to be able to selectively vary or hold the phase position of the rotors. This may be the case, for example, during the starting phase or during the idle phase. During said phases, the device would vibrate in an uncontrolled manner, which would lead to increased noise emissions, increased wear, unsettled running and increased emissions of the internal combustion engine. To prevent this, it is possible to provide mechanical locking devices which rotationally fixedly couple the two rotors to one another during the critical phases of the internal combustion engine, with it being possible for said coupling to be eliminated by virtue of the locking device being charged with pressure medium.

A device of said type is known for example from U.S. Pat. No. 6,439,181 B1, in which an outer rotor is rotatably mounted on an inner rotor which is designed as an impeller, with a plurality of pressure spaces being formed between the outer rotor and inner rotor, which pressure spaces are each divided by means of the vanes into two pressure chambers which act counter to one another. Also provided are two rotational angle limiting devices, with one rotational angle limiting device, in the locked state, restricting a relative rotation of the rotors with respect to one another to an angle range between a maximum late position and a defined central position (locking position). The other rotational angle limiting device, in the locked state, permits a rotation of the inner rotor relative to the outer rotor in an angle range between the maximum early position and the central position. If both rotational angle limiting devices are in the locked state, then the phase position of the inner rotor relative to the outer rotor is restricted to the central position (locking position). Also provided in said embodiment is an auxiliary control mechanism, which, in the locked state, restricts the relative phase position of the inner rotor with respect to the outer rotor to an angle range between a central late position and the maximum early position.

In the locking position, in each case one locking plate, which is arranged in a receptacle of the outer rotor with a force in the direction of the inner rotor, engages in each case into a locking depression formed opposite on the inner rotor, as a result of which the respective rotational angle limiting device passes from the unlocked into the locked state. Each of the rotational angle limiting devices can be moved from the locked into the unlocked state by virtue of the respective locking depression being charged with pressure medium. Here, the pressure medium forces the locking plates back into their receptacle, as a result of which the mechanical coupling of the inner rotor to the outer rotor is eliminated.

The charging of the locking depressions with pressure medium takes place in each case via a connecting line to the pressure chambers. Here, the associated locking depressions of the two rotational angle limiting devices, which in the locked state restrict the phase position of the inner rotor with respect to the outer rotor to the central position, are supplied with pressure medium, in each case, via one of the pressure chambers which act as lag and as lead chambers respectively, while the locking depression, which corresponds to the auxiliary control mechanism, likewise communicates with one of the pressure chambers which act as lag chambers.

A disadvantage of the illustrated embodiment is the fact that the rotational angle limiting devices and the auxiliary control mechanism are controlled by means of the pressure prevailing in the pressure chambers. During an engine start, it is possible, with rising pressure medium pressure in the pressure chambers, for the device to inadvertently unlock and for the phase relationship between the crankshaft and the camshaft to be adjusted in the direction of the maximum late position as a result of the friction torques acting on said camshaft. Furthermore, in said embodiment, a preload component is required in order, during an engine start of the internal combustion engine in a maximum or in a central late position, to permit an adjustment into the locking position by means of the action of the preload force of the preload component counter to the friction torques acting on the camshaft. Here, the device arrives in the locked state only after a time delay, with the inner rotor performing periodic oscillating movements relative to the outer rotor on account of the alternating torques acting on the camshaft from the reaction forces from the actuation of the gas exchange valves. This leads to increased noise emissions, increased wear, unsettled running and increased emissions of the internal combustion engine.

Provision is also made in said embodiment for all of the pressure chambers and all of the locking depressions to be connected to a tank during the stopping and starting phases of the internal combustion engine, which leads to an insufficient supply of lubricant to the device and, therefore, to increased wear. This situation is also disadvantageous, since, before an adjustment of the device, the emptied pressure chambers must be filled with pressure medium, and the adjusting process is therefore subject to a time delay.

SUMMARY OF THE INVENTION

The invention is based on the object of creating a device for the variable adjustment of the control times of gas exchange valves of an internal combustion engine and a method for controlling a device for the variable adjustment of the control times of a gas exchange valves of an internal combustion engine, with it being possible for the inner rotor to be mechanically locked relative to the outer rotor in a central phase position between the maximum early position and the maximum late position. Here, secure locking should be ensured outside the normal engine operation of the internal combustion engine during stopping and starting processes of the internal combustion engine, and the device should be sufficiently supplied with lubricant at all times. Furthermore, after an unlocking process, a reliable adjustment of the device into a regulated state should be permitted.

According to the invention, the object is achieved in that the locking states of at least a first and a second rotational angle limiting device can be controlled by means of a separate control line, and the locking states of at least a third rotational angle limiting device can be controlled independently of at least a first and a second rotational angle limiting device.

According to the invention, a plurality of rotational angle locking devices are provided. Since the control line is formed separately from the pressure medium ducts and pressure medium lines which provide a supply to the pressure chambers, it is possible for the locking states to be set by means of a supply of pressure medium to or a discharge of pressure medium from at least a first and a second rotational angle limiting device via the separate control line, independent of the pressure prevailing in the pressure chambers. Furthermore, the locking states of at least a third rotational angle limiting device can be set, for example, by means of the pressure prevailing in at least one of the pressure chambers, independent of at least a first and a second rotational angle limiting device. In this way, at least a third rotational angle limiting device can be controlled independently of at least a first and a second rotational angle limiting device. By means of a discharge of pressure medium via one of the pressure chambers, it is, for example, possible for a third rotational angle limiting device to be moved into or held in the locked state. At the same time, a first and a second rotational angle limiting device can be moved into or held in the unlocked state by being charged with pressure via the separate control line. During a shut-down process of the internal combustion engine, it is thus possible for the inner rotor to be shut down in a defined angle range, which encompasses the locking position, relative to the outer rotor. Furthermore, it is possible, for example during a starting process of the internal combustion engine, for pressure medium to be discharged from the first and second rotational angle limiting devices via the separate control line, as a result of which said rotational angle limiting devices can be moved into or held in the locked state. In this way, the device can be mechanically fixed in a central phase position independently of the pressure prevailing in the pressure chambers, and an automatic unlocking as a result of the rising system pressure, or an inadvertent adjustment of the device, is reliably prevented.

At the same time, at least one of the pressure chambers can be connected via the control valve to the pump, as a result of which a sufficient supply of lubricant to the device is ensured even during the start phase and during the engine stopping phase.

It is also conceivable for at least a third rotational angle limiting device to be controllable via a further separate control line, independent of at least a first and a second rotational angle limiting device.

In one physical embodiment of the invention, the locking states of at least a third rotational angle limiting device can be controlled exclusively by means of the pressure prevailing in at least one of the pressure chambers.

In one preferred variant of the invention, it is provided that, for the activation of the locking states, a third rotational angle limiting device communicates via a connecting line with at least one of the pressure chambers or with one of the pressure medium ducts.

It may advantageously be provided here that, for the activation of the locking states, a first and a second rotational angle limiting device communicate by means of a separate control line, with the control line communicating neither with the pressure medium ducts nor with the pressure chambers.

In a further physical embodiment of the invention, it may be provided that the locking states of the third rotational angle limiting device are controlled exclusively by means of the pressure prevailing in one or more pressure chambers which act as lag chambers.

It is advantageously the case that, when the first and second rotational angle limiting devices are locked, the inner rotor is fixed relative to the outer rotor in a locking position.

Furthermore, it is possible for the third rotational angle limiting device, in the locked state, to restrict a phase position of the rotor which interacts with the camshaft relative to the rotor which interacts with the crankshaft to an angle range between a maximum early position and the locking position.

Here, it is advantageously possible for the third rotational angle limiting device, in the locked state, to prevent the rotation of the rotor which interacts with the camshaft relative to the rotor which interacts with the crankshaft in the direction of a maximum late position when the locking position is assumed.

Furthermore, it is possible for the first rotational angle limiting device, in the locked state, to restrict a phase position of the rotor which interacts with the camshaft relative to the rotor which interacts with the crankshaft to an angle range between the maximum late position and the locking position.

Here, it is advantageously possible for the first rotational angle limiting device, in the locked state, to prevent the rotation of the rotor which interacts with the camshaft relative to the rotor which interacts with the crankshaft in the direction of a maximum early position when the locking position is assumed.

Furthermore, it is possible for the second rotational angle limiting device, in the locked state, to restrict a phase position of the rotor, which interacts with the camshaft relative to the rotor, which interacts with the crankshaft, to an angle range between the maximum early position and the locking position.

Here, it is advantageously possible for the second rotational angle limiting device, in the locked state, to prevent the rotation of the rotor, which interacts with the camshaft relative to the rotor, which interacts with the crankshaft, in the direction of a maximum late position when the locking position is assumed.

A control valve is also provided which controls the pressure medium supply to and the pressure medium discharge from the pressure medium ducts and the control line.

Here, the control valve has two working ports, wherein the first working port communicates with the first pressure chambers and the second working port communicates with the second pressure chambers, and the control line communicates at the valve side exclusively with a control port which is formed separately from the working ports.

In the embodiment of the device according to the invention, a locking mechanism is provided by means of which the outer rotor can be mechanically coupled to the inner rotor in a locking position between a maximum early position and a maximum late position. It is advantageously possible for three rotational angle limiting devices to be provided, with each of said rotational angle limiting devices being composed of a spring-loaded locking pin which is arranged axially in a bore of the inner rotor. Each locking pin is acted on in the direction of the outer rotor with a force by means of a spring. Three locking guide slots are formed on the outer rotor or on a cover which is fixedly connected to said outer rotor, which locking guide slots are situated opposite the locking pins in certain operating positions of the device. In said operating positions, it is possible for the pins to engage axially into the locking guide slots, thereby generating a mechanical coupling between the outer rotor and the inner rotor. Here, the respective rotational angle limiting device passes from the unlocked state into the locked state. In other operating positions, in which the respective locking pin is not situated opposite the associated locking guide slots, the respective locking pin is covered by the cover which is fixedly connected to the outer rotor, and said locking pin cannot engage into the associated guide slot, such that the respective rotational angle limiting device is held in the unlocked state.

By charging the respective locking guide slot with pressure medium, it is possible for each of the rotational angle limiting devices to be moved from the locked state into the unlocked state. Here, the pressure medium forces the respective locking pins back into their bores, as a result of which the mechanical coupling of the inner rotor to the outer rotor is eliminated.

In each of the rotational angle limiting devices, it is possible by means of a supply of pressure medium to or a discharge of pressure medium from the individual rotational angle limiting devices to set two possible locking states, specifically a locked state, in which the respective locking pin is situated opposite the associated locking guide slot and pressure medium is discharged from the latter such that the respective locking pin can engage into the associated locking guide slot, as a result of which, a mechanical coupling is produced between the rotors, and an unlocked state, in which the respective locking guide slot is charged with pressure medium and the respective locking pin is forced back into the bore by the pressure medium, as a result of which the mechanical coupling between the rotors by the respective rotational angle limiting device is eliminated.

In an alternative refinement, it is possible for one or more rotational angle limiting devices to be designed as a locking element, wherein in the locking position, a locking pin of the locking element engages into a cutout which is matched to the locking pin or into a blind bore which is matched to the locking pin.

In one preferred variant of the invention, provision is advantageously made of a first, a second and a third rotational angle limiting device, wherein the first rotational angle limiting device, in the locked state, restricts the relative phase position of the inner rotor with respect to the outer rotor to a range between the maximum late position and the locking position, while the second rotational angle limiting device, in the locked state, permits a phase position between the maximum early position and the locking position. It is thereby ensured that the inner rotor can be mechanically fixed in a central phase position relative to the outer rotor.

Furthermore, the third rotational angle limiting device, in the locked state, restricts the relative phase position of the inner rotor with respect to the outer rotor to a range between the maximum early position and the locking position. In this way, it is obtained that, during the critical operating phases outside the normal engine operation of the internal combustion engine, for example during the engine start phase or during the engine stopping or idle phase, in which the pressure medium pressure is too low to selectively vary or hold the phase position of the rotors, an adjustment of the relative phase position of the rotors with respect to one another beyond the locking position in the direction of the maximum late position as a result of the friction torques acting on the camshaft is prevented when the locking position is assumed.

Each of the rotational angle limiting devices can be moved from the locked state into the unlocked state by being charged with pressure medium. Here, the first and the second rotational angle limiting device, which, in the locked state, restrict the relative rotation of the rotors with respect to one another to a range between the maximum late position and the locking position or to a range between the maximum early position and the locking position, respectively, communicate with a separate control line. The third rotational angle limiting device, which in the locked state restricts the relative rotation of the inner rotor with respect to the outer rotor to a range between the maximum early position and the locking position, communicates via a connecting line, for example via a worm groove, with at least one of the pressure chambers or pressure medium ducts.

The control line is advantageously formed separately from the pressure medium lines and pressure medium ducts, which provide pressure medium to the pressure chambers. It is therefore possible for the locking states of the first and second rotational angle limiting devices to be activated via the separate control line, and for said first and second rotational angle limiting devices to be moved into or held in the locked or unlocked state, independent of the pressures prevailing in the pressure chambers. It is also ensured in this way that the device, in the unlocked state, can be adjusted in both adjustment directions in each case beyond the locking position by virtue of the pressure chambers which act as lead chambers and the pressure chambers which act as lag chambers being varyingly charged with pressure medium.

Since the control line is formed independently from the pressure medium lines which provide a supply to the device, it is possible during the start phase of the internal combustion engine for the first and second rotational angle limiting devices to be connected via the control line and via the control valve to the tank. In this way, the device can be mechanically fixed in a central phase position independently of the pressure prevailing in the tank, and an automatic unlocking or an inadvertent adjustment of the device even under rising system pressure is reliably prevented.

At the same time, at least one of the pressure chambers can be connected via the control valve to the pressure medium supply, as a result of which a sufficient supply of lubricant to the device is ensured even during the starting phase and during the engine stopping phase.

By means of the separate activation of at least one rotational angle limiting device by means of at least one of the pressure chambers, it is also possible, during the shut-down process of the internal combustion engine, for the inner rotor to be shut down in a defined angle range, which encompasses the locking position, relative to the outer rotor.

In particular, it may be provided that the locking states of the third rotational angle limiting device, which, in the locked state, restricts the relative phase position of the inner rotor with respect to the outer rotor to a range between the maximum early position and the locking position, to be controlled by means of the pressure prevailing in one or more pressure chambers which act as lag chambers. In this way, it is also possible, during the shut-down process, for the inner rotor to be shut down in a defined angle range between a maximum early position and the locking position relative to the outer rotor. Already during the shut-down process, or alternatively, during the restart of the internal combustion engine, the inner rotor automatically passes into the locking position, with a rotationally fixed mechanical connection being produced between the rotors by means of the rotational angle limiting devices.

Alternatively, the object on which the invention is based is achieved by means of a method for controlling a device for adjusting the control times of gas exchange valves of an internal combustion engine, in which the locking states of at least a first and a second rotational angle limiting device are controlled by means of a separate control line, and the locking states of at least a third rotational angle limiting device are controlled independently of at least a first and a second rotational angle limiting device. The method proposed according to the invention serves in particular to control the above-described device for adjusting the control times of gas exchange valves of an internal combustion engine.

It is advantageously provided, according to the invention, that the first and the second rotational angle limiting devices are moved into or held in the locked state by means of a discharge of pressure medium out of the separate control line, and at the same time, the pressure chambers which act as lag chambers are charged with pressure medium while a simultaneous discharge of pressure medium takes place out of the pressure chambers which act as lead chambers. In this way, the device can be mechanically fixed in a central phase position during the start phase of the internal combustion engine independently of the pressure prevailing in the pressure chambers, and an automatic unlocking or an inadvertent adjustment of the device is reliably prevented even under rising system pressure. At the same time, at least one of the pressure chambers can be connected via the control valve to the pressure medium supply, as a result of which a sufficient supply of lubricant to the device is ensured even during the start phase.

It is also advantageously provided according to the invention that the first and the second rotational angle limiting devices are moved into or held in the unlocked state by virtue of the separate control line being charged with pressure medium, and at the same time, the pressure chambers which act as lead chambers are charged with pressure medium while a simultaneous discharge of pressure medium takes place out of the pressure chambers which act as lag chambers.

Here, it may advantageously be provided that the phase position of the rotor, which interacts with the camshaft relative to the rotor, which interacts with the crankshaft, is restricted to an angle range between the maximum early position and the locking position. It may be provided in particular, that the locking states of the third rotational angle limiting device, which in the locked position restricts the relative phase position of the inner rotor with respect to the outer rotor to a range between the maximum early position and the locking position, are controlled by means of the pressure prevailing in the one or more pressure chambers which act as lag chambers. In this way, it is possible, during the shut-down process of the internal combustion engine, for the inner rotor to be shut down in a defined angle range between a maximum early position and the locking position relative to the outer rotor. Already during the shut-down process or alternatively during the re-start of the internal combustion engine, the inner rotor automatically passes into the locking position, with a rotationally fixed mechanical connection being produced between the rotors by means of the rotational angle limiting devices.

It is also provided, according to the invention, that the first and the second rotational angle limiting devices are moved into or held in the unlocked state by virtue of the separate control line being charged with pressure medium, and at the same time, the pressure chambers which act as lag chambers are charged with pressure medium while a simultaneous discharge of pressure medium takes place out of the pressure chambers which act as lead chambers.

In this way, it is ensured that, independent of the pressure prevailing in the pressure chambers, the device can be held in the unlocked state, and can be adjusted in both adjustment directions beyond the locking position in each case into a regulated position, by virtue of the pressure chambers which act as lead chambers and the pressure chambers which act as lag chambers being varyingly charged with pressure medium.

It is also advantageously provided that the first and the second rotational angle limiting devices are held in the unlocked state by virtue of the separate control line being charged with pressure medium, and the pressure medium supply to and the pressure medium discharge from the pressure chambers are interrupted. In this way, it is possible to hold the phase position of the rotors relative to one another in a regulated position.

BRIEF DESCRIPTION OF THE DRAWINGS

Further features of the invention can be gathered from the following description and from the drawings, which illustrate in simplified form an exemplary embodiment of the invention. In the drawings:

FIGS. 3-11 shows schematic illustrations of a cross section through one of the pressure spaces with the position of the adjusting vane (Figure a), a partial longitudinal section of the device with the position of the locking mechanism in the individual operating states (Figure b), and symbolic illustrations of the internal connections in the shift positions of the control valve (Figure c);

FIG. 3*a* shows the position of the adjusting vane in the pressure space during an engine stop (switching position 4);

FIG. 3*b* shows the position of the locking pins with the guide slots in the cover during an engine stop (switching position 4);

FIG. 3*c* shows the switching position of the control valve during an engine stop (switching position 4);

FIG. 4*a* shows the position of the adjusting vane in the pressure space when the engine is at a standstill (switching position 1);

FIG. 4*b* shows the position of the locking pins with the guide slots in the cover when the engine is at a standstill (switching position 1);

FIG. 4*c* shows the switching position of the control valve when the engine is at a standstill (switching position 1);

FIG. 5*a* shows the position of the adjusting vane in the pressure space during an engine start 1 (switching position 1);

FIG. 5*b* shows the position of the locking pins with the guide slots in the cover during an engine start 1 (switching position 1);

FIG. 5*c* shows the switching position of the control valve during an engine start 1 (switching position 1);

FIG. 6*a* shows the position of the adjusting vane in the pressure space during an engine start 2 (switching position 1);

FIG. 6*b* shows the position of the locking pins with the guide slots in the cover during an engine start 2 (switching position 1);

FIG. 6*c* shows the switching position of the control valve during an engine start 2 (switching position 1);

FIG. 7*a* shows the position of the adjusting vane in the pressure space during an engine start 3 (switching position 1);

FIG. 7*b* shows the position of the locking pins with the guide slots in the cover during an engine start 3 (switching position 1);

FIG. 7*c* shows the switching position of the control valve during an engine start 3 (switching position 1);

FIG. 8*a* shows the position of the adjusting vane in the pressure space during unlocking (switching position 2);

FIG. 8*b* shows the position of the locking pins with the guide slots in the cover during unlocking (switching position 2);

FIG. 8*c* shows the switching position of the control valve during unlocking (switching position 2);

FIG. 9*a* shows the position of the adjusting vane in the pressure space during an adjustment in the late direction (switching position 2);

FIG. 9*b* shows the position of the locking pins with the guide slots in the cover during an adjustment in the late direction (switching position 2);

FIG. 9*c* shows the switching position of the control valve during an adjustment in the late direction (switching position 2);

FIG. 10*a* shows the position of the adjusting vane in the pressure space in a regulated position (switching position 3);

FIG. 10*b* shows the position of the locking pins with the guide slots in the cover in a regulated position (switching position 3);

FIG. 10*c* shows the switching position of the control valve in a regulated position (switching position 3);

FIG. 11*a* shows the position of the adjusting vane in the pressure space during an adjustment in the early direction (switching position 4);

FIG. 11*b* shows the position of the locking pins with the guide slots in the cover during an adjustment in the early direction (switching position 4); and FIG. 11*c* shows the switching position of the control valve during an adjustment in the early direction (switching position 4).

DETAILED DESCRIPTION OF THE DRAWINGS

Figures 1, 2:
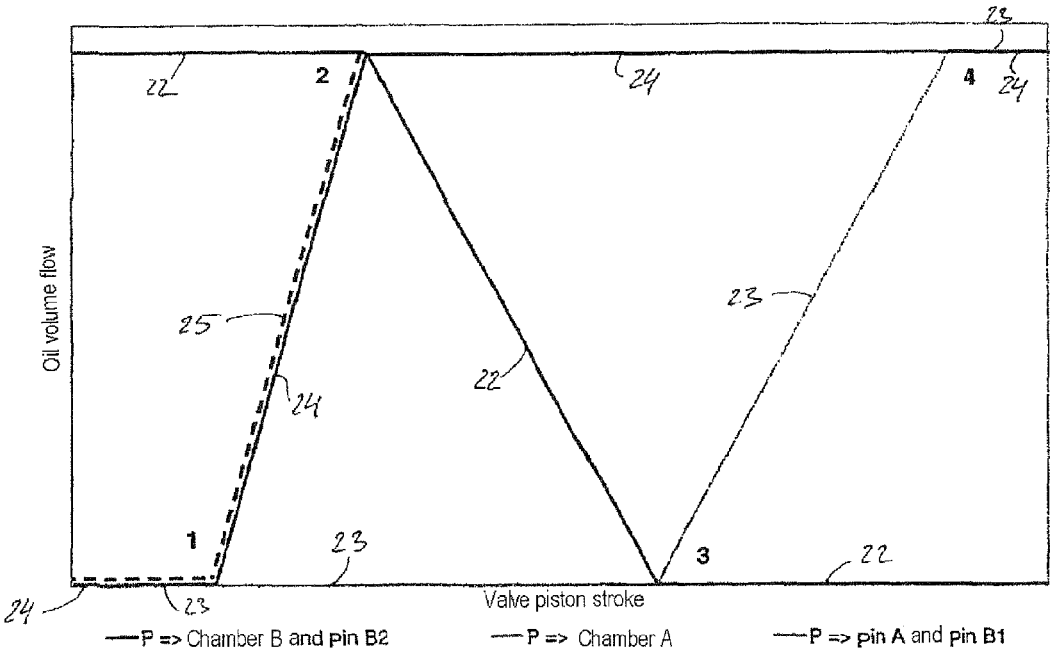
FIG. 1 shows a tabular illustration of the switching positions of the control valve in the individual operating states.
FIG. 2 shows a graphic illustration of the pressure medium flow as a function of the valve piston stroke in the individual switching positions of the control valve.

FIGS. 1 to 11 show, in highly schematic form and by way of example, an embodiment of the invention with its significant parts in the respective operating states.

FIGS. 3*a* to 11*a* illustrate a cross section through one of the pressure spaces 7 with two pressure chambers 9, 10 which act counter to one another and with the respective position of the adjusting vane 6. The embodiment according to the invention is composed of a plurality of such groups of pressure chambers 9, 10; it is for example possible for five groups of pressure chambers 9, 10 to be provided.

The outer rotor 2 is arranged so as to be rotatable relative to the inner rotor 3 in a defined angle range. The angle range is delimited in one rotational direction of the outer rotor 2 by virtue of each vane 6 coming to bear, in a maximum early position, against a boundary wall 8, which is designed as an early stop 8*a*, of the pressure chamber 7. Similarly, the angle range in the other rotational direction is delimited by virtue of each vane 6 coming to bear against the other boundary wall 8 of the pressure chamber 7, which other boundary wall 8 serves as a late stop 8*b* in a maximum late position. Alternatively, a rotation limiting device may be provided which limits the rotational angle range of the outer rotor 2 with respect to the inner rotor 3.

By charging one group of pressure chambers 9, 10 with pressure medium and relieving the other group of pressure, it is possible to vary the phase position of the outer rotor 2 relative to the inner rotor 3. By charging both groups of pressure chambers 9, 10 with pressure medium, the phase position of the two rotors 2, 3 relative to one another can be held constant. Alternatively, it may be provided that none of the pressure chambers 9, 10 is acted on with pressure medium during phases of constant phase position. In both of the latter settings, the inner rotor 2 is hydraulically braced relative to the outer rotor 3 within the respective pressure spaces 7. As hydraulic pressure medium, use is conventionally made of the lubricant of the internal combustion engine (not illustrated).

For the supply of pressure medium to and the discharge of pressure medium from the pressure chambers 9, 10, a pressure medium system is provided which comprises a pressure medium pump (not illustrated), a tank (likewise not illustrated), a control valve (not illustrated) and a plurality of pressure medium lines (not illustrated). Pressure medium fed by the pressure medium pump is supplied to the control valve via a further pressure medium line (not illustrated). Said pressure medium line is connected to the pressure medium lines of the pressure medium system according to the control state of the control valve (FIG. 1 and FIGS. 3*c* to 11*c*).

The inner rotor is, for example, formed with two groups of pressure medium ducts (not illustrated), with each pressure medium duct extending for example from a receptacle (not illustrated) of the inner rotor on the camshaft (not illustrated) to one of the pressure chambers 9, 10. The pressure medium ducts of the inner rotor 3 communicate with pressure medium lines, in each case formed for this purpose, of the pressure medium system. For this purpose, it is possible in particular to provide a pressure medium distributor, which is arranged in the receptacle of the inner rotor 3. In an alternative embodiment, the control valve is designed as a central valve and is arranged in the receptacle of the inner rotor 3, wherein in this case the control valve connects the pressure medium supply directly to the pressure medium ducts.

To displace the control times (opening and closing times) of the gas exchange valves of the internal combustion engine in the early direction, the pressure medium, which is supplied to the control valve via the pressure medium system, is conducted via pressure medium ducts to the group of first pressure chambers 9. At the same time, pressure medium from the group of second pressure chambers 10 passes to the control valve via further pressure medium ducts and is discharged into the tank. As a result, the vanes 6 are displaced in the direction of the early stop 8*a*, thereby generating a rotational movement of the inner rotor 3 relative to the outer rotor 2 in the rotational direction of the device.

To displace the control times of the gas exchange valves of the internal combustion engine in the late direction, the pressure medium which is supplied to the control valve via the pressure medium system is conducted via pressure medium ducts to the group of second pressure chambers 10. At the same time, pressure medium from the group of first pressure chambers 9 passes to the control valve via further pressure medium ducts and is discharged into the tank. As a result, the vanes 6 are displaced in the direction of the late stop 8*b*, thereby generating a rotational movement of the inner rotor 3 relative to the outer rotor 2 counter to the rotational direction of the device.

To hold the control times constant, the supply of pressure medium to all the pressure chambers 9, 10 is either prevented or enabled. As a result, the vanes 6 are hydraulically braced within the respective pressure chambers 7, and a rotational movement of the inner rotor 3 relative to the outer rotor 2 is thereby prevented.

During the start of the internal combustion engine or during idle phases, the supply of pressure medium to the device may not be sufficient to ensure the hydraulic bracing of the vanes 6 within the pressure chambers 7. To prevent an uncontrolled oscillation of the inner rotor 3 relative to the outer rotor 2, a locking element 11 is provided which produces a mechanical connection between the two rotors 2, 3. Here, a locking pin 15, 16, 17 is arranged in one of the rotors 2, 3 while a locking guide slot 18, 19, 20 is formed in the other rotor 2, 3. If the inner rotor 3 is situated in a defined phase position (locking position 21) relative to the outer rotor 3, then the respective locking pin 15, 16, 17 can engage into the associated locking guide slot 18, 19, 20 and thereby produce a mechanically rotationally fixed connection between the two rotors 2, 3.

It has proven to be advantageous to select the locking position such that, when the device is in the locked state, the vanes 6 are situated in a position between the early stop 8*a* and the late stop 8*b*. Such a locking mechanism is illustrated in FIGS. 3*b* to 11*b*. Said Figures show a partial longitudinal section through one of the side covers 4, 5 with the locking guide slots 18, 19, 20 and the position of the locking pins 15, 16, 17 in individual operating states of the internal combustion engine. One of the side covers 4, 5, each, is arranged on one of the axial side surfaces of the outer rotor 2 and is rotationally fixedly connected thereto. The locking mechanism 11 is composed of a first, a second and a third rotational angle limiting device 13, 14, 12. In the illustrated embodiment, each of the rotational angle limiting devices 12, 13, 14 are composed of an axially movable locking pin 15, 16, 17, with each of the locking pins 15, 16, 17 being held in an axial bore (not illustrated) of the inner rotor 3. Furthermore, three guide slots 18, 19, 20 in the form of grooves which run in the circumferential direction are formed in the cover 4, 5. Each of said locking pins 15, 16, 17 is acted on in the direction of the cover 4, 5 with a force by means of a spring element (not illustrated). If the inner rotor 3 assumes a position relative to the outer rotor 2 in which a locking pin 15, 16, 17 is situated axially opposite the associated locking guide slot 18, 19, 20, then said locking pin 15, 16, 17 is forced into the locking guide slot 18, 19, 20 and the respective rotational angle limiting device 12, 13, 14 is moved from an unlocked state into a locked state.

Here, the locking guide slot 19 of the first rotational angle limiting device 13 is restricted to a range between a maximum late position 8*b* and the locking position 25. If the inner rotor 3 is situated in the locking position 21 relative to the outer rotor 2, then the locking pin 16 of the first rotational angle limiting device 13 bears against a stop which is formed in the circumferential direction by the locking guide slot 19, as a result of which a further adjustment in the direction of earlier control times is prevented.

Similarly, the locking guide slot 20 of the second rotational angle limiting device 14 is designed such that, when the second rotational angle limiting device 14 is locked, the phase position of the inner rotor 3 relative to the outer rotor 2 is restricted to an angle range between the maximum early position 8*a* and the locking position 21. If the inner rotor 3 is situated in the locking position 21 relative to the outer rotor 2, then the locking pin 17 of the second rotational angle limiting device 14 bears against a stop which is formed in the circumferential direction by the locking guide slot 20, as a result of which a further adjustment in the direction of later control times is prevented.

The locking guide slot 18 of the third rotational angle limiting device 12 is similarly designed such that, when the third rotational angle limiting device 12 is locked, the phase position of the inner rotor 3 relative to the outer rotor 2 is restricted to a range between a maximum early position 8*a* and the locking position 21. If the inner rotor 3 is situated in the locking position 21 relative to the outer rotor 2, then the locking pin 15 of the third rotational angle limiting device 12 bears against a stop which is formed in the circumferential direction by the locking guide slot 18, as a result of which a further adjustment in the direction of later control times is prevented.

In order to move the rotational angle limiting devices 12, 13, 14 from the locked state into the unlocked state, it is provided that the respective locking guide slot 18, 19, 20 is charged with pressure medium. In this way, the respective locking pin 15, 16, 17 is forced back into the bore on the inner rotor 3 counter to the force of the spring element, and the rotational angle limitation is thereby eliminated.

In the illustrated embodiment, provision is also made for the locking guide slot 19 of the first rotational angle limiting device 13 and the locking guide slot 20 of the second rotational angle limiting device 14, which locking guide slots 19 and 20, in the locked state, restrict the rotation of the inner rotor 3 relative to the outer rotor 2 to an angle range between the maximum late position 8*b* and the locking position 21 or to an angle range between the maximum early position 8*a* and the locking position 21, respectively, to be supplied with pressure medium via a control line (not illustrated).

Provision is also made in the exemplary embodiment according to the invention for the locking guide slot 18 of the third rotational angle limiting device 12, which, in the locked state, prevents the rotation of the inner rotor 3 relative to the outer rotor 2 in the late direction at the locking position 21, to be supplied with pressure medium via a connecting line (not illustrated) from one of the second pressure chambers 10 which act as lag chambers.

Here, it is provided that the control valve (not illustrated) regulates both the pressure medium flows to and from the first and second pressure chambers 9, 10 and also to and from the control line.

Three ports connect the control valve to the device. A first working port A communicates with the pressure medium line via which the first pressure chambers 9 are supplied with pressure medium. The second working port B+pin $B_2$ communicates with the pressure medium line via which the second pressure chambers 10 are supplied with pressure medium. A control port pin A+pin $B_1$ communicates with the separate control line via which both the guide slot 19 of the first rotational angle limiting device 13 and also the guide slot 20 of the second rotational angle limiting device 14 can be charged with pressure medium. A supply port P for the pressure medium pump (not illustrated) provides a permanent flow of pressure medium to the device. The pressure medium can be discharged into a tank (not illustrated) via a discharge port T. The ports P and T can be connected to the oil circuit of the engine, with the oil pressure of said oil circuit being dependent on the engine rotational speed and the oil temperature. The port T then allows the oil which is displaced in the device to flow back into the oil circuit of the engine.

The control valve may be designed as a conventional plug-in valve or else as a central valve. It is also conceivable for more than 5 ports to be provided on the control valve; in particular, it is also possible to provide multiple ports for the discharge of pressure medium into the tank.

Furthermore, the control valve may for example be formed with an electric actuating unit, by means of which the working ports A, B+pin $B_2$ and the control port pin A+pin $B_1$ can be selectively connected, as a function of the supply of electric current, to the supply port P, to the discharge port T or to neither of these.

The individual switching positions of a control valve of said type in individual operating states of the internal combustion engine are shown in FIG. 1 in tabular form. In switching position 1, the control valve is not supplied with electrical current and the device is situated in the locking position during the engine start of the internal combustion engine. The first working port chamber A and the control port pin A+pin $B_1$ are each switched to the discharge port T, such that pressure medium can be discharged out of the first pressure chambers 9 and out of the guide slots 19, 20, which communicate with the control line, into the tank. At the same time, the second working port chamber B+pin $B_2$ is connected to the supply port P, as a result of which the second pressure chambers 10 and the guide slot 18, which communicates with at least one of said second pressure chambers 10, of the third rotational angle limiting device are charged with pressure medium once the pressure medium pump, synchronously with the engine rotational speed, provides a sufficient pressure medium pressure.

For the unlocking of the device and an adjustment in the direction of later control times of the gas exchange valve, the control valve is moved into switching position 2. Here, the working port chamber B+pin $B_2$ and the control port pin A+pin $B_1$ are connected to the supply port P, as a result of which the second pressure chambers 10 and the control line are charged with pressure medium and the rotational angle limiting devices 12, 13, 14 are moved into the unlocked state. At the same time, the working port chamber A is connected to the discharge port T, as a result of which pressure medium is discharged from the first pressure chambers 9 into the tank. As a result, the vanes 6 are displaced in the direction of the late stop 8*b* and the inner rotor 3 is rotated relative to the outer rotor 2 counter to the rotational direction of the device.

In switching position 3 of the control valve, the device can be held in a regulated position in order to keep the control times of the gas exchange valves constant. In said position, the supply and discharge of pressure medium to and from all the pressure chambers 9, 10 is prevented. With the exception of leakage compensation in the pressure chambers 9, 10, no exchange of pressure medium takes place between the pressure chambers 9, 10 and the tank via the discharge port T or between the pressure chambers 9, 10 and the pressure medium pump via the supply port P. As a result, the vanes 6 are hydraulically braced within the respective pressure chambers 7, and a rotational movement of the inner rotor 3 relative to the outer rotor 2 is therefore prevented. At the same time, the control port pin A+pin $B_1$ is connected to the pressure medium supply port P, as a result of which the control line and the guide slots 19, 20, which communicate with said control line, are charged with pressure medium and the first and second rotational angle limiting devices 13, 14 are held in the unlocked state.

To adjust the device in the direction of earlier control times of the gas exchange valves, the control valve is moved into the switching position 4. Here, the working port chamber A is connected to the pump P and the first pressure chambers 9 are charged with pressure medium, while the second working port chamber B+pin $B_2$ is switched to the discharge port T, as a result of which pressure medium is discharged from the second pressure chambers 10 into the tank. As a result, the vanes 6 are displaced in the direction of the early stop 8*a* and the inner rotor 3 is rotated relative to the outer rotor 2 in the rotational direction of the device. At the same time, the control port pin A+pin $B_1$ is likewise connected to the supply port P, as a result of which the guide slots 19, 20, which communicate with the control line, are charged with pressure medium and the first and second rotational angle limiting devices 13, 14 are moved into or held in the unlocked state.

Since, in switching positions 1 and 4, in each case one of the groups of pressure chambers 9, 10 is connected to the pressure medium pump, it is possible to ensure a sufficient supply of pressure medium to the device, even during the engine start and engine stop or engine standstill phases.

FIG. 2 shows, in a diagram, a simplified illustration of the graphic profile of the pressure medium flow at the working ports chamber A (curve 23) and chamber B+pin $B_2$ (curve 22) and at the control port pin A+pin $B_1$ (curve 24) as a function of the valve piston stroke in the individual switching positions of the control valve. In switching positions 2 and 4, large pressure medium flows at the working port B+pin $B_2$ or at the working port A are obtained with high adjusting speeds (curves 22 and 23).

The profile illustrated in FIG. 2 can also be transferred to a device in which the control valve is designed as a central valve. In said refinement, a sufficient supply of lubricant to the device is ensured directly via the central valve, such that in switching position 1, the second working port chamber B+pin $B_2$ can be switched to the tank. The profile of a possible variant of said type is illustrated by curve 25.

The internal connections of the ports of the control valve in the individual switching positions are symbolically illustrated in FIGS. 3*c* to 11*c*.

During the engine stopping phase of the internal combustion engine (FIGS. 3*a*, 3*b* and 3*c*), the control valve is supplied with a full electrical current, and is moved into switching position 4, after the "ignition off" signal from the engine controller. Here, the first working port A and the control port pin A+pin $B_1$ or pins A+$B_1$ are connected to the pressure medium supply port P (FIG. 3*c*). In this way, the first pressure chambers 9 and the locking guide slots 19, 20 of the first and second rotational angle limiting devices 13, 14 are charged with pressure medium, as a result of which said first and second rotational angle limiting devices 13, 14 are moved into or held in the unlocked state (FIG. 3*b*) for as long as the pressure medium pump, synchronously with the engine rotational speed of the internal combustion engine, provides a sufficient pressure medium pressure. At the same time, the second working port B+pin $B_2$ is connected to the pressure medium discharge port T, such that pressure medium can flow out of the second pressure chambers 10 to the tank (FIG. 3*c*). This causes a relative rotation of the inner rotor 3 with respect to the outer rotor 2 in the direction of the maximum early position 8*a*, and corresponds to an adjustment of the device in the direction of earlier control times of the gas exchange valves (compare below), with the inner rotor 3 moving into a position between the locking position 21 and the maximum early position 8*a* (FIG. 3*a*). At the same time, the locking pin 15 can lock into the guide slot 18 which is situated opposite, which guide slot 18 communicates with at least one of the pressure chambers 10 from which pressure medium is discharged into the tank. In this way, the third rotational angle limiting device 12 is moved into the locked state and the relative rotation of the rotors with respect to one another is restricted to an angle range between the maximum early position 8*a* and the locking position 21. In this way, it is achieved that, during the stopping phase of the internal combustion engine, the inner rotor 3 can be shut down in a defined angle range, between the locking position 21 and the maximum early position 8*a*, relative to the outer rotor 2.

After the engine has come to a standstill (FIGS. 4*a*, 4*b* and 4*c*), the control valve is not provided with an electrical current and is situated in switching position 1. Here, the first working port A and the control port pins A+$B_1$ are connected to the pressure medium discharge port T, as a result of which pressure medium can flow out of the first pressure chambers 9 and out of the guide slots 19, 20 into the tank, while the second working port chamber B+pin $B_2$ is switched to the pressure medium supply P (FIG. 4*c*). On account of the lack of system pressure, the third rotational angle limiting device 12, which communicates with one of the second pressure chambers 10, is situated in the locked state (FIG. 4*b*). At the same time, the locking pin 16 can engage into the guide slot 19, as a result of which the second rotational angle limiting device 14 is moved into the locked state (FIG. 4*b*). In contrast, the locking pin 16 is not situated opposite the associated guide slot 19, such that the first rotational angle limiting device 13 cannot be moved into the locked state (FIG. 4*b*).

The internal combustion engine starts from said angle position during the engine start phase (FIGS. 5*a*, 5*b* and 5*c*; 6*a*, 6*b* and 6*c*; 7*a*, 7*b* and 7*c*). Here, the control valve is situated in the start position (switching position 1, FIGS. 5*c*, 6*c* and 7*c*) which corresponds to the switching position when the engine is at a standstill (FIG. 4*c*). In said phase, it is generally not possible to ensure the hydraulic bracing of the vanes 6 within the pressure spaces 7 on account of the excessively low system pressure. On account of the friction torques acting on the camshaft, the inner rotor 3 is rotated relative to the outer rotor 2 in the direction of the maximum late position 8*b* (FIG. 5*a*). Said movement is stopped by the locked third rotational angle limiting device 12 and the locked second rotational angle limiting device 14 when the locking position 21 is assumed, in which locking position 21 the locking pins 15, 17 come to bear against the stop of the respective guide slots 18, 20 in the late direction (FIG. 5*b*). As a result, the inner rotor 3 automatically passes into the locking position 21 directly after the re-start of the internal combustion engine. Since the control port pin A+pin $B_1$ is connected to the tank, pressure medium is discharged from the control line into the tank (FIG. 5*c*). The locking pin 17, which, in the locking position is situated opposite the guide slot 20, which communicates with the control line, engages into said guide slot 20 and comes to bear against the stop of the guide slot 20 in the late direction (FIG. 5*b*). Once the locking pin 16 of the first rotational angle limiting device 13 is situated opposite the associated slot 19, said locking pin 16 can engage into said slot 19 (FIG. 6*b*). As a result of the first and second rotational angle limiting devices 13, 14 being locked, the inner rotor 3 is mechanically fixed relative to the outer rotor 2 in the locking position 21 (FIGS. 6*a* and 6*b*).

Alternatively, said process may also take place already during the engine stop or engine standstill phase of the internal combustion engine, when, on account of the friction torques and alternating torques or relaxation processes of the internal combustion engine (for example pressure dissipation in the cylinders of the internal combustion engine after the latter has come to a standstill, or the like), the inner rotor 3 is forced into the locking position 21 and the locking pin 16 is situated in the locking position with respect to the associated guide slot 19 and the first rotational angle limiting device 13 can pass into the locked state.

With rising system pressure during the engine start phase, the second pressure chambers 10 and the locking guide slot 18, which is connected to one of said second pressure chambers 10, is charged with pressure medium (FIG. 7*c*), as a result of which the third rotational angle limiting device 12 is moved into the unlocked state (FIG. 7*b*). Since the control port pins A+$B_1$ are connected to the discharge port T during the entire start process (FIGS. 5*c*, 6*c* and 7*c*), pressure medium is discharged from the guide slots 19, 20 into the tank and the first and second rotational angle limiting devices 13, 14 are held in the locked state (FIGS. 7*a* and 7*b*). In this way, the device can be mechanically fixed in the locking position 21 during the start process of the internal combustion engine, and an automatic unlocking, or an inadvertent adjustment of the device under rising system pressure, is reliably prevented.

For unlocking the device (FIGS. 8*a*, 8*b* and 8*c*), the control valve is provided with a small electrical current and is switched into switching position 2, with the control port pins A+$B_1$ being connected to the supply port P (FIG. 8*c*). In this way, the control line and the guide slots 19, 20, which communicate with said control line, are charged with pressure medium and the first and second rotational angle limiting devices 13, 14 are moved into the unlocked state (FIG. 8*b*). In this way, the mechanical fixing of the inner rotor 3 relative to the outer rotor 2 in the locking position 21 is released, and the device can be adjusted out of said position into a regulated position either in the late direction or in the early direction (FIG. 8*a*).

To adjust the control times of the gas exchange valves of the internal combustion engine in the late direction after an unlocking process (FIG. 9*a*, 9*b*, 9*c*), the control valve is supplied with a small electrical current and placed into the lag position (switching position 2, FIG. 9*c*). Here, the first working port A is connected to the discharge port T and, at the same time, the second pressure chambers 10 are switched to the supply port P, as a result of which the second pressure chambers 10 are charged with pressure medium while pressure medium is discharged from the first pressure chambers 9 into the tank. As a result, the vanes 6 are displaced in the direction of the late stop 8*b* (FIG. 9*a*), as a result of which the inner rotor 3 is rotated relative to the outer rotor 2 in the direction of the maximum late position 8*b*, counter to the rotational direction of the device (FIG. 9*a*). At the same time, in said position, the locking guide slots 18, which communicate with the second pressure chambers 10, and the guide slots 20, which communicate with the control line, are charged with pressure medium (FIG. 9*c*), as a result of which the third and second rotational angle limiting devices 12, 14 are held in the unlocked state (FIG. 9*b*). In this way, it is ensured that the vanes 6, during an adjustment from an early position in the direction of the maximum late position 8*b*, can be displaced beyond the locking position 21 without the locking pins 15, 17 of the third and second rotational angle limiting devices 12, 14 coming to bear against the respective stops in the late direction in the locking guide slots 18, 20, and preventing the movement in the late direction (FIG. 9*b*), when the locking position 21 is assumed. Since the locking guide slot 19 which communicates with the control line is charged with pressure medium, the locking guide slot 16 of the first rotational angle limiting device 13 can be held in the unlocked state (FIGS. 11*b* and 11*c*).

In switching position 2, large pressure medium flows at the working port B+pin $B_2$ are obtained with high adjustment speeds (FIG. 2, curve 22).

If a displacement of the phase position in the direction of earlier control times of the gas exchange valves of the internal combustion engine is to take place (FIG. 11*a*, 11*b*, 11*c*), the control valve is supplied with a full electrical current and is placed into the lead position (switching position 4, FIG. 11*c*). In said control position, the first pressure chambers 9 are connected via the first working port A to the supply port P and are charged with pressure medium, while pressure medium can flow out of the second pressure chambers 10 via the second working port B+pin $B_2$ and via the pressure medium discharge port T to the tank (FIG. 11*c*). At the same time, pressure medium is conducted via the control port pins $A+B_1$ and via the control line to the locking guide slots 19, 20 of the first and second rotational angle limiting devices 13, 14 (FIG. 11*c*), as a result of which said first and second rotational angle limiting devices 13, 14 are likewise held in the unlocked state (FIG. 11*b*). The charging of the first pressure chambers 9 with pressure medium while the second pressure chambers 10 are simultaneously emptied leads to a rotation of the inner rotor 3 relative to the outer rotor in the rotational direction of the device, in the direction of the maximum early position 8*a* (FIG. 11*a*). Since the first rotational angle limiting device 13 is held in the unlocked state during the adjustment process, the vanes 6 can, during an adjustment from a late position in the direction of the maximum late position 8*b*, be displaced beyond the locking position 21 without the locking pin 16 coming to bear against the stop in the late direction in the locking slots 19, and preventing the movement in the early direction, when the locking position 21 is assumed (FIG. 9*b*). Furthermore, pressure medium can flow out of the locking guide slot 18, which communicates with one of the second pressure chambers 10, into the tank, as a result of which the locking pin 15 of the third rotational angle limiting device 12 can engage into said locking guide slot 18 (FIGS. 11*b* and 11*c*).

In switching position 4, large pressure medium flows at the working port A are obtained with high adjustment speeds (FIG. 2, curve 23).

If the phase position of the inner rotor 3 relative to the outer rotor 2 is to be held in a regulated angle position (FIG. 10*a*, 10*b*, 10*c*) in order to hold the control times of the gas exchange valves constant, the control valve is supplied with an electrical current in the range of the holding load ratio, and is moved into the holding position (switching position 3, FIG. 10*c*). In said position, the supply of pressure medium to and the discharge of pressure medium from all the pressure chambers 9, 10 is prevented. With the exception of leakage compensation in the pressure chambers 9, 10, no exchange of pressure medium takes place between the pressure chambers 9, 10 and the tank via the discharge port T or between the pressure chambers 9, 10 and the pressure medium pump via the supply port P (FIG. 10*c*). As a result, the vanes 6 are hydraulically braced within the respective pressure spaces 7, and a rotational movement of the inner rotor 3 relative to the outer rotor 2 is therefore prevented (FIG. 10*a*). Here, the control port pins $A+B_1$ remain connected to the supply port P (FIG. 10*c*), as a result of which the guide slots 19, 20 of the first and second rotational angle limiting devices 13, 14 are charged with pressure medium via the control line and are held in the unlocked state (FIG. 10*b*).

LIST OF REFERENCE SYMBOLS

1 Device
2 Outer rotor
3 Inner rotor
4 Side cover
5 Side cover
6 Vane
7 Pressure space
8 Boundary wall
8*a* Early stop
8*b* Late stop
9 First pressure chamber
10 pressure chamber
11 Locking mechanism
12 Rotational angle limiting device
13 Rotational angle limiting device
14 Rotational angle limiting device
15 Locking pin
16 Locking pin
17 Locking pin
18 Guide slot
19 Guide slot
20 Guide slot
21 Locking position
22 Curve
23 Curve
24 Curve
25 Curve
A First working port
B+pin $B_2$ Second working port Pin A+pin $B_1$ Control port
T Discharge port
P Supply port

The invention claimed is:

1. A device for variably adjusting control times of gas exchange valves of an internal combustion engine, comprising:

rotors, the rotors being an outer rotor and an inner rotor, the inner rotor being rotatable relative to the outer rotor, with one of the rotors being drive-connected to a crankshaft and the other one of the rotors being drive-connected to a camshaft;

at least one pressure space, with each pressure space being divided into two pressure chambers which act counter to one another;

a plurality of pressure medium ducts via which a pressure medium is supplied to or discharged from the pressure chambers; and a plurality of rotational angle limiting devices, each of the rotational angle limiting devices being moveable between a locked state and an unlocked state, the locked state and the unlocked state being locking states, the locking states being set by means of a supply of pressure medium to or a discharge of pressure medium from the respective rotational angle limiting devices, wherein the locking states of at least a first and a second rotational angle limiting device are controlled by means of a control line separate from said pressure medium ducts, and the locking states of at least a third rotational angle limiting device are controlled independently of the first rotational angle limiting device and the second rotational angle limiting device.

2. The device of claim 1, wherein the locking states of the third rotational angle limiting device are controlled exclusively by means of pressure prevailing in at least one of the pressure chambers.

3. The device of claim 2, wherein, for activation of the locking states, the third rotational angle limiting device communicates via a connecting line with at least one of the pressure chambers or with one of the pressure medium ducts.

4. The device of claim 3, wherein for activation of the locking states, the first rotational angle limiting device and the second rotational angle limiting device are connected to the control line separate from said pressure medium ducts, with the separate control line communicating neither with the pressure medium ducts nor with the pressure chambers.

5. The device of claim 1, wherein the locking states of the third rotational angle limiting device are controlled exclusively by means of pressure prevailing in the pressure chambers which act as lag chambers.

6. The device of claim 1, wherein, when the first and the second rotational angle limiting devices are locked, the inner rotor is fixed relative to the outer rotor in a locking position.

7. The device of claim 1, wherein the third rotational angle limiting device, in the locked state, restricts a phase position of one of the rotors which interacts with the camshaft relative to the other one of the rotors which interacts with the crankshaft to an angle range between a maximum early position and a locking position.

8. The device of claim 1, wherein the third rotational angle limiting device, in the locked state, prevents rotation of one of the rotors which interacts with the camshaft relative to the other one of the rotors which interacts with the crankshaft in a direction of a maximum late position when a locking position is assumed.

9. The device of claim 1, wherein the first rotational angle limiting device, in the locked state, restricts a phase position of one of the rotors which interacts with the camshaft relative to the other one of the rotors which interacts with the crankshaft to an angle range between a maximum late position and a locking position.

10. The device of claim 1, wherein the first rotational angle limiting device, in the locked state, prevents rotation of one of the rotors which interacts with the camshaft relative to the other one of the rotors which interacts with the crankshaft in a direction of a maximum early position when a locking position is assumed.

11. The device of claim 1, wherein the second rotational angle limiting device, in the locked state, restricts a phase position of one of the rotors which interacts with the camshaft relative to the other one of the rotors which interacts with the crankshaft to an angle range between a maximum early position and a locking position.

12. The device of claim 1, wherein the second rotational angle limiting device, in the locked state, prevents rotation of one of the rotors which interacts with the camshaft relative to the other one of the rotors which interacts with the crankshaft in the direction of a maximum late position when a locking position is assumed.

13. The device of claim 1, wherein a control valve is provided which controls the pressure medium supply to and the pressure medium discharge from the pressure medium ducts and the separate control line.

14. The device of claim 13, wherein the control valve has two working ports, wherein a first working port communicates with a first pressure chambers and a second working port communicates with a second pressure chambers, and wherein the separate control line communicates at a valve side exclusively with a control port which is formed separately from the working ports.

15. A method for controlling a device for adjusting control times of gas exchange valves of an internal combustion engine, comprising:

rotors, the rotors being an outer rotor and an inner rotor with the outer rotor being rotatable relative to an inner rotor;

at least one pressure space, each pressure space being divided into two pressure chambers which act counter to one another;

a plurality of pressure medium ducts via which a pressure medium is supplied to or discharged from the pressure chambers; and a plurality of rotational angle limiting devices being provided, each of the rotational angle limiting devices being moveable between an unlocked or a locked state, the locked state and the unlocked state being locking states, the locking states being set by means of a supply of pressure medium to or a discharge of pressure medium from the respective rotational angle limiting devices, wherein the locking states of at least a first and a second rotational angle limiting device being controlled by means of a control line separate from said pressure medium ducts, and the locking states of at least a third rotational angle limiting device being controlled independently of at least a first and a second rotational angle limiting device.

16. The method of claim 15, wherein the first and the second rotational angle limiting devices are moved into or held in the locked state by means of a discharge of the pressure medium out of the separate control line, and at a same time, the pressure chambers, which act as lag chambers, are charged with the pressure medium while a simultaneous discharge of the pressure medium takes place out of the pressure chambers which act as lead chambers.

17. The method of claim 15, wherein the first and the second rotational angle limiting devices are moved into or held in the unlocked state by virtue of the separate control line being charged with the pressure medium, and at a same time, the pressure chambers, which act as lead chambers, are charged with the pressure medium while a simultaneous discharge of the pressure medium takes place out of the pressure chambers which act as lag chambers.

18. The method of claim 15, wherein a phase position of one of the rotors which interacts with a camshaft relative to the other one of the rotors which interacts with a crankshaft is restricted to an angle range between a maximum early position and a locking position.

19. The method of claim 15, wherein the first and the second rotational angle limiting devices are moved into or held in the unlocked state by virtue of the separate control line being charged with the pressure medium and, at a same time, the pressure chambers, which act as lag chambers, are charged with the pressure medium while a simultaneous discharge of the pressure medium takes place out of the pressure chambers which act as lead chambers.

20. The method of claim 15, wherein the first and the second rotational angle limiting devices are held in the unlocked state by virtue of the separate control line being charged with the pressure medium, and the supply of the pressure medium to and the discharge of the pressure medium from the pressure chambers are interrupted.

* * * * *